US008760069B2

(12) United States Patent
Braun et al.

(10) Patent No.: US 8,760,069 B2
(45) Date of Patent: Jun. 24, 2014

(54) CIRCUIT ARRANGEMENT AND METHOD FOR OPERATING A HIGH PRESSURE DISCHARGE LAMP

(75) Inventors: Alois Braun, Neuburg (DE); Walter Limmer, München (DE); Maximilian Schmidl, Pullach (DE)

(73) Assignee: OSRAM Gesellschaft Mit Beschrankter Haftung, Munich (DE)

( * ) Notice: Subject to any disclaimer, the term of this patent is extended or adjusted under 35 U.S.C. 154(b) by 287 days.

(21) Appl. No.: 13/125,213

(22) PCT Filed: Oct. 23, 2008

(86) PCT No.: PCT/EP2008/064394

§ 371 (c)(1), (2), (4) Date: Apr. 20, 2011

(87) PCT Pub. No.: WO2010/045980

PCT Pub. Date: Apr. 29, 2010

(65) Prior Publication Data

US 2011/0221357 A1 Sep. 15, 2011

(51) Int. Cl.
*H05B 41/231* (2006.01)
*H05B 41/16* (2006.01)

(52) U.S. Cl.
USPC ..... 315/246; 315/207

(58) Field of Classification Search
USPC ..... 315/246, 205, 206, 207, 268, 326, 349
See application file for complete search history.

(56) References Cited

U.S. PATENT DOCUMENTS 4,170,747 A * 10/1979 Holmes ..... 315/307
4,240,009 A 12/1980 Paul
4,734,624 A * 3/1988 Nagase et al. ..... 315/243
6,046,551 A 4/2000 Kita
6,593,703 B2 * 7/2003 Sun ..... 315/224

(Continued)

FOREIGN PATENT DOCUMENTS

CN 101077039 11/2007
DE 100 51 139 4/2002

(Continued)

OTHER PUBLICATIONS

Wan et al., "Electronic Ballast of High Intensity Gas Discharge Lamp", Light Source and Illumination, Jun. 30, 2004.

*Primary Examiner* — Daniel D Chang
(74) *Attorney, Agent, or Firm* — Cozen O'Connor

(57) ABSTRACT

A method for operating a high pressure discharge lamp, with the high pressure discharge lamp being operated by a current inverter with a square wave lamp current having a positive phase with positive current flow and a negative phase with negative current flow, and with the current inverter being controlled by a control arrangement wherein the method comprises the steps of measuring a value for the positive current flow representing the lamp wattage or the square wave lamp current, measuring a value for the negative current flow representing the lamp wattage or the square wave lamp current; calculating a predetermined setpoint value in each case from a guide variable of a lamp wattage or of the square wave lamp current and the measured value for the phase with positive current flow; calculating a predetermined setpoint value in each case from a guide variable of a lamp wattage or of the square wave lamp current and the measured value for the phase with negative current flow; and outputting the two predetermined setpoint values to the current inverter.

16 Claims, 2 Drawing Sheets

(56) References Cited

U.S. PATENT DOCUMENTS

Figure 1:
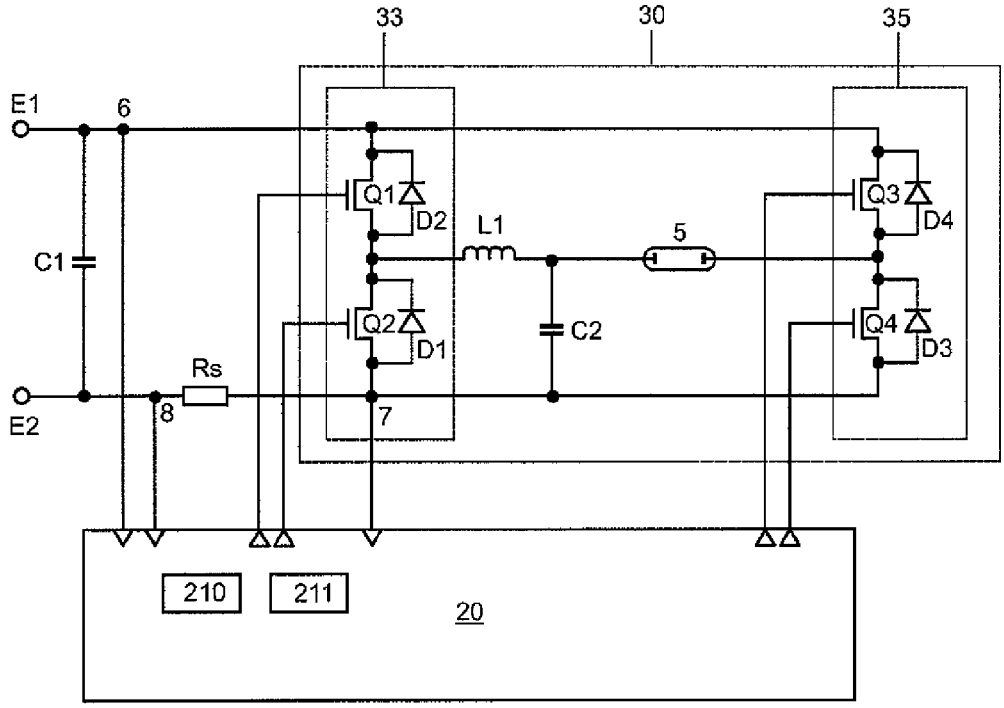

| | | | | |
|---|---|---|---|---|
| 6,670,779 | B2 * | 12/2003 | Shen | 315/291 |
| 7,382,101 | B2 * | 6/2008 | Fukuda et al. | 315/308 |
| 2002/0101183 | A1 | 8/2002 | Bens | |
| 2004/0263089 | A1 | 12/2004 | Contenti | |

FOREIGN PATENT DOCUMENTS

| | | |
|---|---|---|
| EP | 1 066 739 | 1/2001 |
| WO | WO 87/07995 | 12/1987 |
| WO | WO 99/34647 | 7/1999 |

* cited by examiner

CIRCUIT ARRANGEMENT AND METHOD FOR OPERATING A HIGH PRESSURE DISCHARGE LAMP

RELATED APPLICATIONS

This is a U.S. National Stage of application No. PCT/EP2008/064394, filed on Oct. 23, 2008.

FIELD OF THE INVENTION

The invention is related to a method and a circuit arrangement for operating a high pressure discharge lamp.

BACKGROUND OF THE INVENTION

High pressure discharge lamps are often operated with a square wave current of a lower frequency in order to simulate direct current operation. This operating mode is often referred to as intermittent DC mode. The frequency of the low-frequency square wave current in such cases is a maximum of one power greater than the input AC mains frequency. In principle a high pressure discharge lamp is thus operated in dc mode, but the polarity of the lamp current is regularly reversed in order to place an even load on the lamp electrodes.

In such cases a power control system is generally implemented in order to operate the high pressure discharge lamp. With old lamps asymmetries in the lamp voltage sometimes occur, which can lead to undesired power fluctuations. These fluctuations can be suppressed by a correspondingly rapid control. Rapid control steps with a small time constant however have the disadvantage of a tendency for the high pressure discharge lamp to flicker during its operation. If the control has a very large time constant the tendency to flicker is small, but the asymmetries cannot be compensated for as a result of the large time constant of the control.

A large control time constant is to be understood here as a value which is much, i.e. by a power, greater than the time constant of the underlying operating frequency of the square wave lamp current.

SUMMARY OF THE INVENTION

One object of the invention is to provide a method for operating a high pressure discharge lamp, with the high pressure discharge lamp being operated by a current inverter with a square wave lamp current having a positive phase with positive current flow and a negative phase with negative current flow, and the current inverter being controlled by a control arrangement which operates with a very slow control with a very large time constant, and which regulates out any asymmetries which might possibly occur in the lamp current.

This object is achieved in accordance with one aspect of the present invention directed to a method for operating a high-pressure discharge lamp in which the high-pressure discharge lamp is operated by a current inverter with a square wave lamp current having a positive phase with a positive current flow and a negative phase with a negative current flow and the current inverter being controlled by a control arrangement. The method includes the following steps:

Measuring a value representing the lamp wattage or the square wave lamp current for the positive current flow, measuring a value representing the lamp wattage or the square wave lamp current for the negative current flow, calculating a setpoint value from a guide variable of a lamp wattage or of the square wave lamp current and the measured value for the phase with positive current flow in each case, calculating a setpoint value from a guide variable of a lamp wattage or of the square wave lamp current and the measured value for the phase with negative current flow in each case, outputting the two setpoint values to the current inverter.

The square wave lamp current preferably has a frequency of less than 500 Hz, especially less than 110 Hz in this case. This means that the lamp is practically operated with a direct current and the load on the electrodes is even and minimal.

The guide variable of a lamp wattage or of the square wave lamp current for the control arrangement is preferably the same for both phases in this case. This means that the lamp is controlled to the same wattage in each phase, which results in an even load on the electrodes.

If the value representing the lamp wattage or the square wave lamp current is calculated for the control arrangement from the input voltage of the current inverter, the input current of the current inverter, the voltage of the high-pressure discharge lamp and also a correction factor, the complex lamp current measurement can be omitted and yet the lamp wattage can still be calculated with sufficient accuracy.

In such cases there is preferably a period of time between the consecutive setpoint values of the two phases which is between 1 ms and a few seconds, especially between 5 ms and 50 ms long. This enables a slow and low-cost control to be implemented which shows little tendency to flickering during operation.

Another aspect of the invention is directed to a circuit arrangement by a circuit arrangement for operating a high-pressure discharge lamp having a current inverter for operating the high-pressure discharge lamp which generates a low-frequency square wave lamp current, with the square wave lamp current having a positive phase with positive current flow and a negative phase with negative current flow, and the current inverter being controlled by a control arrangement, with the control arrangement controlling the positive phase and the negative phase separately from one another.

The guide variable of a lamp wattage or of the square wave lamp current for the control arrangement is preferably the same for both phases in such cases. This means that the lamp is controlled in each phase to the same wattage, which results in an even load on the electrodes.

Preferably the control arrangement in such cases measures the input voltage of the current inverter, the input current of the current inverter and the voltage of the high pressure discharge lamp and calculates a value representing the lamp wattage or the square wave lamp current from these variables, with the aid of a correction factor and the guide variable. This enables the complex lamp current measurement to be dispensed with and yet the lamp wattage still to be calculated with sufficient accuracy.

Preferably the control arrangement determines a value representing the lamp wattage or the square wave lamp current in each phase individually and generates a setpoint value for each phase on the basis of the measured value. This allows the control arrangement to create a sufficiently precise setpoint value for each phase with little effort.

To simplify the processing the control arrangement in this case preferably stores a value representing the lamp wattage or the square wave lamp current respectively in memory cells separated from one another belonging to the two phases. The control arrangement now preferably creates a setpoint value for each phase individually by means of the stored values, which is then output to the current inverter.

The control arrangement preferably generates the setpoint values at an interval which is between 1 ms in a few seconds long, especially between 5 ms and 50 ms long. This enables a slow and low-cost control to be implemented which exhibits less tendency to flicker during operation. The frequency of the setpoint values in such cases is preferably lower by at least one power than the frequency of the square wave lamp current.

In such cases the control arrangement preferably features a digital controller with a microcontroller. Since a microcontroller is implemented in many modern circuit arrangements for operating discharge lamps, the inventive control arrangement can be implemented as pure software, which cuts costs.

BRIEF DESCRIPTION OF THE DRAWING(S)

Further advantages, features and details of the invention emerge with reference to the following description of exemplary embodiments and also with reference to the drawings in which elements having the same or an equivalent function are provided with identical reference characters. The figures show:

FIG. 1 a schematic diagram of a circuit arrangement which executes the inventive method.

Figure 2:
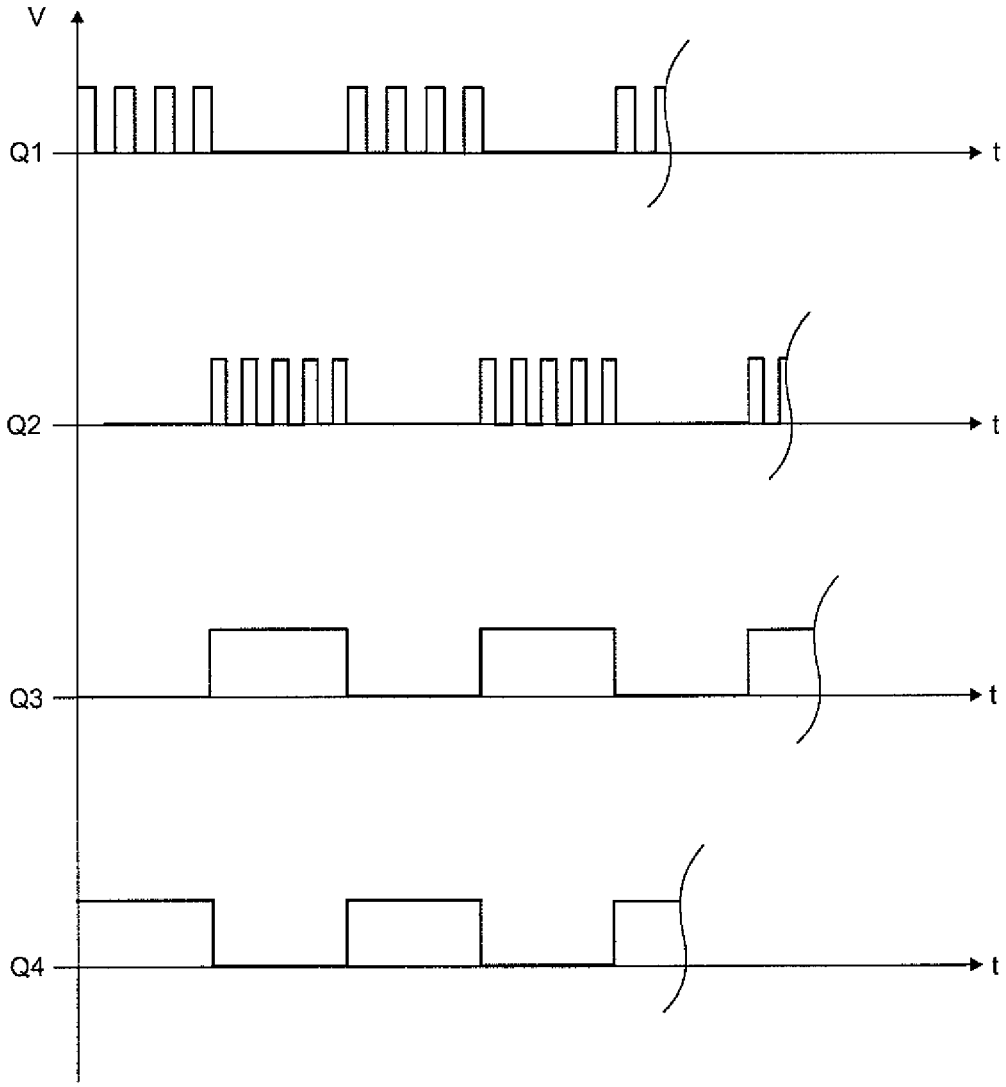

FIG. 2 the schematically-depicted control voltages of the switching transistors of the full bridge which is controlled by the control unit.

PREFERRED EMBODIMENT OF THE INVENTION

FIG. 1 shows a schematic block diagram of the circuit arrangement which carries out the inventive method. The circuit arrangement features a current inverter 30 with all parts which are needed for normal operation. Additional components such as ignition choke, ignition capacitor, driver circuits, etc. which are needed for starting a high-pressure discharge lamp 5 and for other conceivable operating states have been omitted for reasons of clarity. The current inverter 30 consists of a full bridge with 2 parallel-switched half bridges 33 and 35, which each have two switching transistors Q1, Q2 and also Q3, Q4. The switching transistors Q1-Q4 possess antiparallel free running diodes D1-D4. Connected between the center points of the two half bridges 33, 35 is a series circuit of the high pressure discharge lamp 5 and a lamp choke L1. Connected between the connection point of the high-pressure discharge lamp 5 and the lamp choke L1 and the connection point of the lower full-bridge transistors Q2 and Q4, which is referred to the below as point 7, is a capacitor $C_2$. Connected between the upper input E1, which is at the same potential as point 6, and the lower input E2, which is at the same potential as point 8, is an input capacitor C1. A current measurement resistor $R_s$ is connected between point 8 and point 7.

The current inverter 30 is controlled by a control unit 20 during execution of the inventive method. The control unit 20 measures the input voltage of the current inverter 30, i.e. the voltage between point 6 and point 7. In this case a strong RC filtering is used to filter out faults and short-term fluctuations of the input voltage of the current inverter 30.

The control unit 20 likewise measures the voltage across the current measurement resistor $R_s$, which is equivalent to the current through the current inverter 30. This value is measured individually in the positive phase of the square wave lamp current and in the negative phase of the square wave lamp current. Since the full bridge of the current inverter 30, as will be explained again later, has step-down characteristics, the square wave lamp current is a factor of the current through the full bridge. For each measurement the control unit 20 stores the value of the current in memory cells 210, 211, separated from one another and belonging to the individual phases.

The control unit 20 now calculates the output of the current inverter 30 for each phase individually with the assistance of the stored values for the current and outputs a respective setpoint value for Q1 and Q2. This means that asymmetries of the lamp or different impedances in the different phases or different driver run times now no longer play any role since the positive phase and the negative phase of the current are each given their own setpoint value. New setpoint values are not calculated in such cases for each low-frequency full wave but are only calculated for every nth low-frequency full wave. n in this case is able to assume a value of between 5 and several hundred. The setpoint values are thus output to the current inverter at an interval of between 1 ms and a few seconds. The setpoint value can thus under some circumstances also only be output every 2-3 seconds. The fact that the control differentiates between positive half wave and negative half wave and that these half waves are controlled separately enables a very slow and thereby low-cost control to be used without operating the lamp asymmetrically. A direct current component in the lamp current is safely avoided in this way.

The current inverter 30 is controlled in such cases such that the transistors of the full bridge are controlled with a low-frequency square wave voltage. In this case the low-frequency control voltage of the transistors Q1 and Q2 is overlaid in the first half bridge 33 with a high-frequency control voltage. The second half bridge 35 of the full bridge 30 is controlled in this case only with a low square wave voltage. The high-frequency overlaying can in such cases be a pulse width modulation or another suitable type of control. Low-frequency operation is seen here as operation at a frequency which generally lies at a maximum of one power above the input ac mains frequency. The frequency of low-frequency operation preferably lies between 50 Hz and 900 Hz. Consequently high-frequency operation is seen as operation at a frequency which lies at least one power higher than the frequency of the low-frequency operation. The frequency of high-frequency operation preferably lies between 3 kHz and 120 kHz.

For reasons of clarity the drivers for the upper transistors Q1 and Q3 as well as the high-frequency controls for the half bridge 33 are not shown in the schematic diagram of FIG. 1.

FIG. 2 shows the schematically-depicted control voltages of the switching transistors Q1-Q4 of the current inverter 30, which are controlled by the control unit 20. The transistors Q3 and Q4 of the half bridge 35 are controlled by a low-frequency voltage so that they are each completely through connected in each half wave. The transistors are switched in a complementary manner in order to generate a positive and a negative current phase through the high-pressure discharge lamp. The transistors Q1 and Q2 of the half bridge 33 are likewise operated by a low-frequency voltage. This low-frequency voltage is additionally overlaid by a high-frequency square wave voltage, as can be seen from FIG. 2. The high-frequency overlay or control voltage respectively can be generated by pulse width modulation or by another suitable method. Thus while Q3 is through connected, Q2 is controlled by a high-frequency voltage. Q1 and Q4 are switched off. While Q4 is through connected, Q1 is controlled by a high-frequency voltage. During this time Q2 and Q3 are switched off.

This high-frequency control voltage enables the square wave lamp current to be adapted to a possible asymmetry of the high-pressure discharge lamp 5 which may be present. The fact that the lamp current is controlled individually in each phase also enables the frequency of the overlay or control voltage respectively or the pulse width modulation of this voltage to differ from the positive phase to the negative phase, which results in a different lamp current in the positive and in the negative phase. Together with the non-symmetrical lamp voltage this produces a completely symmetrical power consumption in both phases, which results in an even load on the electrodes of the high-pressure discharge lamp 5 and thus prolongs the life of the high-pressure discharge lamp.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A method for operating a high pressure discharge lamp, with the high pressure discharge lamp being operated by a current inverter with a square wave lamp current having a positive phase with positive current flow and a negative phase with negative current flow, and with the current inverter being controlled by a control arrangement, the method comprising the steps of:

measuring a value for the positive current flow representing one of a wattage of the high pressure discharge lamp and the square wave lamp current;

measuring a value for the negative current flow representing one of the wattage of the high pressure discharge lamp and the square wave lamp current;

calculating a first predetermined setpoint value in each case from a guide variable of one of (i) the wattage of the high pressure discharge lamp and (ii) the square wave lamp current and the measured value for the phase with positive current flow;

calculating a second predetermined setpoint value in each case from the guide variable of one of (i) the wattage of the high pressure discharge lamp and (ii) the square wave lamp current and the measured value for the phase with negative current flow; and outputting the first and second predetermined setpoint values to the current inverter;

wherein a time interval is provided between consecutive setpoint values of the positive and negative phases which is between 1 ms and a few seconds long.

2. The method for operating a high pressure discharge lamp as claimed in claim 1, wherein the square wave lamp current has a frequency of less than 500 Hz.

3. The method for operating a high pressure discharge lamp as claimed in claim 1, wherein the guide variable of a lamp wattage of the square wave lamp current for the control arrangement is the same for the positive and negative phases.

4. The method for operating a high pressure discharge lamp as claimed in claim 1, wherein a value representing one of the wattage of the high pressure discharge lamp and the square wave lamp current for the control arrangement is calculated from one of (i) the wattage of the high pressure discharge lamp and (ii) an input voltage of the current inverter, an input current of the current inverter, a voltage of the high pressure discharge lamp and a correction factor.

5. The method for operating a high pressure discharge lamp as claimed in claim 1, wherein the time interval is between 5 ms-50 ms long.

6. The circuit arrangement for operating the high pressure discharge lamp as claimed in claim 1, wherein a frequency of the first and second setpoint values is smaller by at least one power than a frequency of the square wave lamp current.

7. The circuit arrangement for operating the high pressure discharge lamp as claimed in claim 1, wherein the control arrangement includes a digital controller with a microcontroller.

8. The method for operating the high pressure discharge lamp as claimed in claim 1, wherein the square wave lamp current has a frequency of less than 500 Hz.

9. The method for operating the high pressure discharge lamp as claimed in claim 1, wherein the square wave lamp has a frequency of less than 110 Hz.

10. A circuit arrangement for operating a high pressure discharge lamp, comprising:

a current inverter operating the high pressure discharge lamp with a square wave lamp current having a positive phase with positive current flow and a negative phase with negative current flow; and a control arrangement controlling the current inverter;

wherein the control arrangement controls the positive phase and the negative separately from one another; and wherein the control arrangement creates a setpoint value at an interval which is between 1 ms and a few seconds long.

11. The circuit arrangement for operating the high pressure discharge lamp as claimed in claim 10, wherein a guide variable for the control arrangement is the same for the positive phase and for the negative phase.

12. The circuit arrangement for operating the high pressure discharge lamp as claimed in claim 10, wherein the control arrangement measures an input current of the current inverter and a voltage of the high pressure discharge lamp, and a value representing one of the wattage of the high pressure discharge lamp and the square wave lamp current is calculated for the control arrangement from these variables aided by a correction factor and a guide variable.

13. The circuit arrangement for operating the high pressure discharge lamp as claimed in claim 12, wherein the control arrangement determines a value representing one of the wattage of the high pressure discharge lamp and the square wave lamp current in each phase, and creates a predetermined setpoint value for each phase based on a measured value.

14. The circuit arrangement for operating the high pressure discharge lamp as claimed in claim 13, wherein the control arrangement stores a respective value representing one of the wattage of the high pressure discharge lamp and the square wave lamp current in memory cells separated from one another belonging to the positive and negative phases.

15. The circuit arrangement for operating the high pressure discharge lamp as claimed in claim 14, wherein the control arrangement creates a setpoint value individually for each phase via the stored respective values, which is then output to the current inverter.

16. The circuit arrangement for operating the high pressure discharge lamp as claimed in claim 15, wherein the interval is between 5 ms and 50 ms long.

* * * * *